US010443985B2

(12) United States Patent
Cosentino

(10) Patent No.: US 10,443,985 B2
(45) Date of Patent: Oct. 15, 2019

(54) KINEMATIC RAIL MOUNT FOR MOUNTING A DEVICE ON A FIREARM RAIL

(71) Applicant: Steiner eOptics, Inc., Waitsfield, VT (US)

(72) Inventor: Tim J. Cosentino, Waitsfield, VT (US)

(73) Assignee: STEINER E-OPTICS, INC., Waitsfield, VT (US)

( * ) Notice: Subject to any disclaimer, the term of this patent is extended or adjusted under 35 U.S.C. 154(b) by 0 days.

(21) Appl. No.: 15/984,957

(22) Filed: May 21, 2018

(65) Prior Publication Data

US 2018/0340755 A1 Nov. 29, 2018

Related U.S. Application Data

(60) Provisional application No. 62/510,139, filed on May 23, 2017.

(51) Int. Cl.
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS 5,806,228 A * 9/1998 Martel ..... F41G 11/003 42/124
7,685,759 B2 3/2010 Teetzel
8,393,105 B1 3/2013 Thummel
8,572,885 B2 * 11/2013 Karagias ..... F41G 11/003 42/124
9,581,416 B1 * 2/2017 Yim ..... F41G 11/003
10,030,940 B2 * 7/2018 Sheets, Jr. ..... F41G 11/003
2008/0155876 A1 7/2008 Matthews et al.
2013/0333184 A1 12/2013 Couture et al.

FOREIGN PATENT DOCUMENTS

EP 3064823 A1 * 9/2016 ..... F16M 11/041

OTHER PUBLICATIONS

Machine translation of EP 3064823 A1 (Year: 2016).*
European Search Report, corresponding to EP18173583, dated Sep. 5, 2018, 1 page.
European Search Report, corresponding to EP18173573, dated Sep. 4, 2018, 1 page.

* cited by examiner

*Primary Examiner* — Joshua T Semick
(74) *Attorney, Agent, or Firm* — Innovation Counsel LLP

(57) ABSTRACT

The present disclosure provides a kinematic rail mount for mounting a device on a rail that includes a topmost surface and an under surface along opposing sides of the rail. According to an embodiment, the mount comprises a frame having a length along a first direction, a width along a second direction, and a height along a third direction; and a clamp operatively connected to the frame to be slidable along the second direction. The frame has a first end portion and a second end portion arranged along the first direction and an intermediate portion disposed between the first and second end portions. The clamp includes a guide disposed in a channel formed in the intermediate portion of the frame. The first end portion and second end portion include, respectively, a first raised pad and a second raised pad. The intermediate portion includes a third raised pad.

14 Claims, 8 Drawing Sheets

KINEMATIC RAIL MOUNT FOR MOUNTING A DEVICE ON A FIREARM RAIL

CROSS REFERENCE TO RELATED APPLICATIONS

This application claims benefit of priority to U.S. Provisional Patent Application No. 62/510,139 titled "A KINEMATIC RAIL MOUNT FOR MOUNTING A DEVICE ON A FIREARM RAIL" and filed May 23, 2017, which is incorporated herein by reference in its entirety.

RELATED FIELD

The present disclosure relates to a mount for mounting a device on a firearm rail.

BACKGROUND

Firearms have been around a long time, and their designs have evolved greatly and continue to evolve. One aspect of this evolution is that modern firearms have become more modular. For example, many modern firearms include an accessory rail on which various devices, such as a telescopic sight, a holographic sight, a laser sight, a flashlight, etc., may be mounted. While there are many existing mounts for mounting a device on an accessory rail, these existing mounts generally suffer from drawbacks outlined below.

Typically, when a new sight is first mounted on a firearm, the point of aim of the sight would need to be adjusted to match the point of impact of the firearm. This process is generally known as "zeroing" the sight, which can be an arduous task for most shooters. However, because different sights offer different advantages, a shooter may want to swap out the sights after zeroing. Thus, it is desirable for the sight to maintain its point of aim, or "return to zero," despite repetitions of un-mounting and re-mounting the sight. Unfortunately, with many of the existing mounts, the point of aim of the mounted sight tends to shift between repetitions of un-mounting and re-mounting due to the over constrained clamping mechanism utilized by these mounts.

Embodiments of the present disclosure substantially overcome the above-discussed drawbacks of existing mounts for a mounting device on a firearm rail.

SUMMARY

The present disclosure provides a kinematic rail mount for mounting a device on a rail that includes a topmost surface and an under surface along opposing sides of the rail. According to an embodiment, the mount comprises a frame having a length along a first direction, a width along a second direction, and a height along a third direction; and a clamp operatively connected to the frame to be slidable along the second direction to clamp the mount to the rail. The frame has a first end portion and a second end portion arranged along the first direction and an intermediate portion disposed between the first and second end portions. The clamp includes a guide disposed in a channel formed in the intermediate portion of the frame. The first end portion and second end portion include, respectively, a first raised pad and a second raised pad. The intermediate portion includes a third raised pad.

BRIEF DESCRIPTION OF THE DRAWINGS

The accompanying drawings, which are included as part of the present disclosure, illustrate various embodiments and together with the general description given above and the detailed description of the various embodiments given below serve to explain and teach the principles described herein.

Figure 2:
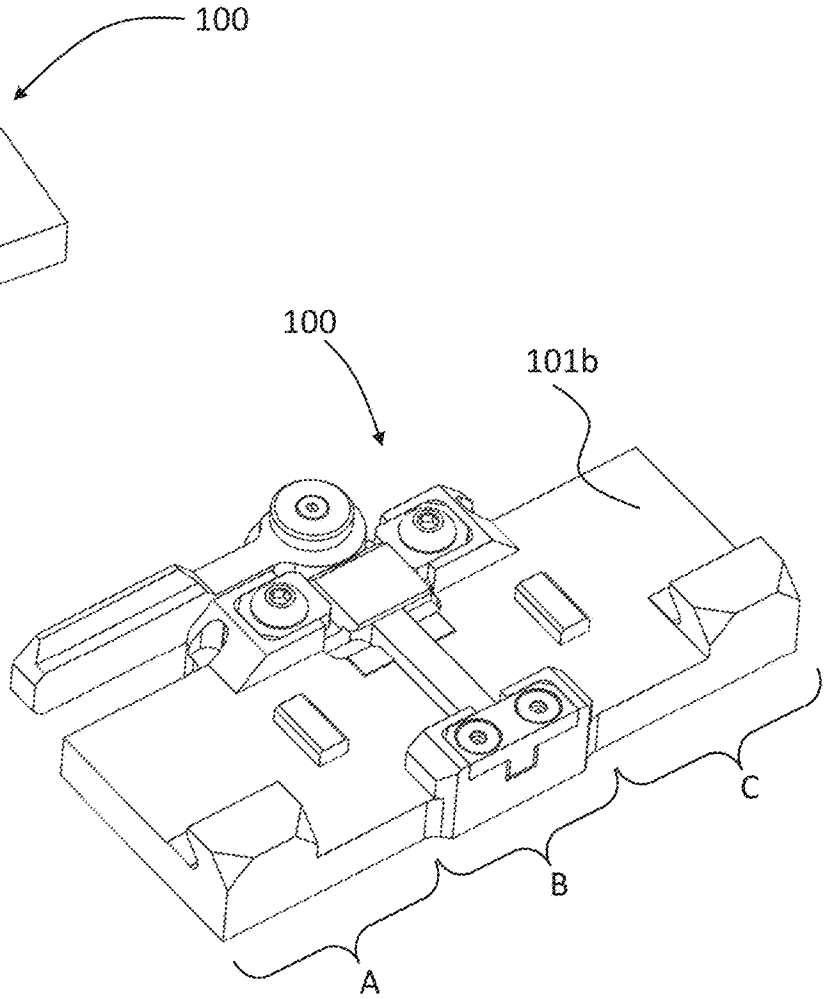
FIG. 2 is a bottom view of the same mount, according to an example embodiment of the present disclosure.

The figures in the drawings are not necessarily drawn to scale and elements of similar structures or functions are generally represented by like reference numerals for illustrative purposes throughout the figures. The figures are only intended to facilitate the description of the various embodiments described herein and do not describe every aspect of the teachings disclosed herein and do not limit the scope of the claims.

DETAILED DESCRIPTION

Each of the features and teachings disclosed herein may be utilized separately or in conjunction with other features and teachings to provide the present system and method. Representative examples utilizing many of these features and teachings, both separately and in combination, are described with reference to the attached figures. While the detailed description herein illustrates to a person of ordinary skill in the art further details for practicing aspects of the present teachings, it does not limit the scope of the claims. Therefore, combinations of features disclosed in the detailed description are representative examples of the present teachings and may not be necessary to practice the teachings in the broadest sense.

Relative terms, such as "top," "bottom," "left," "right," etc., may be used herein to describe the spatial relations of components shown in the figures. As such, when used in such context, these terms should be construed in accordance with the spatial orientation of the components as depicted in the relevant figures and not as absolute terms.

Figure 1:
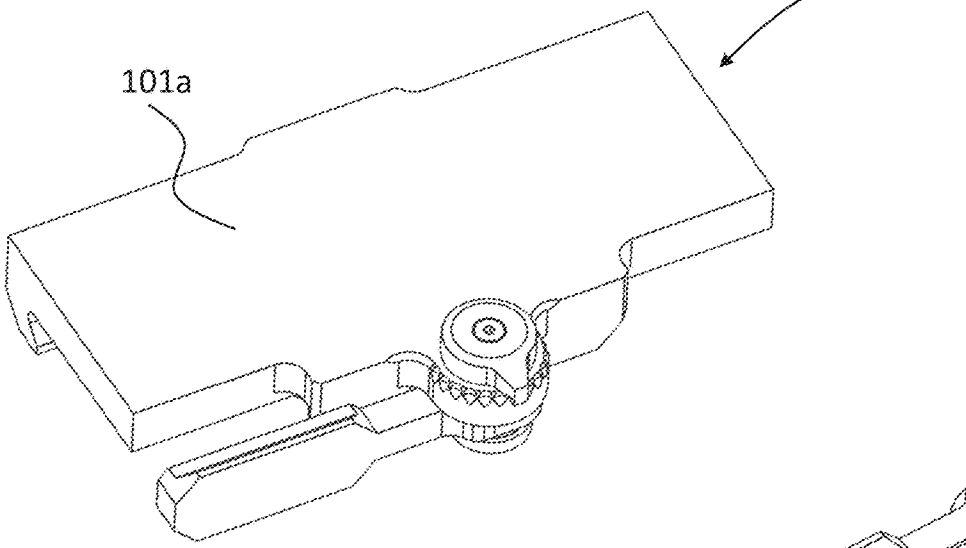
FIG. 1 is a top view of a kinematic rail mount for mounting a device on a firearm rail, according to an embodiment of the present disclosure.

FIG. 1 is a top view of a kinematic rail mount 100 for mounting a device on a firearm rail, and FIG. 2 is a bottom view of the same mount, according to an example embodiment of the present disclosure. The device, which is not shown, may, for example, be attached to a top surface 101*a* of the kinematic rail mount 100 (or just "mount" hereinafter for convenience), or a case for housing the device may be integrally formed with the mount 100.

Figure 3:
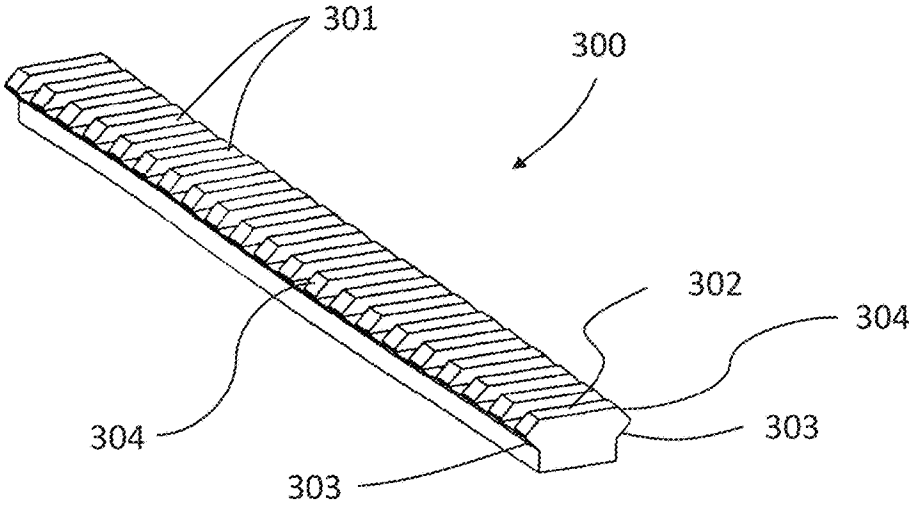
FIG. 3 shows an example of a firearm rail on which the mount may be mounted.
Figure 4:
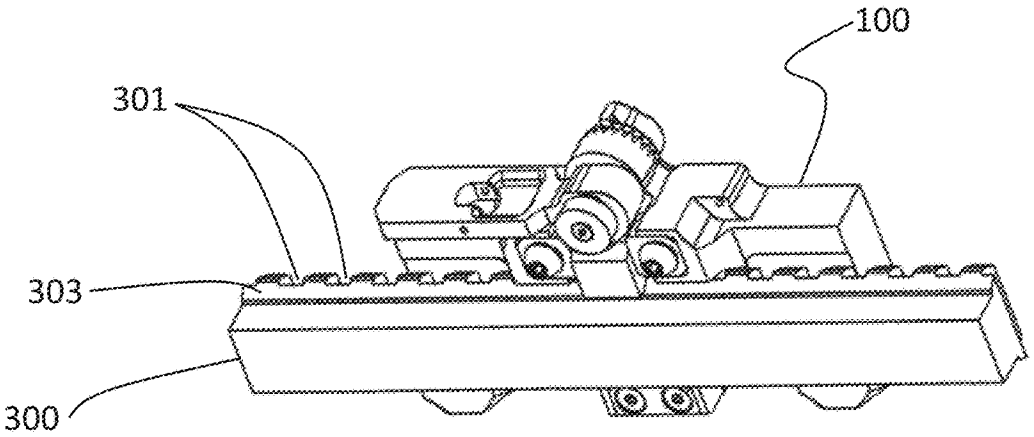
FIG. 4 shows an example of how the mount may be mounted onto the rail, according to an example embodiment.

FIG. 3 shows an example of a firearm rail on which the mount may be mounted, and FIG. 4 shows an example of how the mount may be mounted onto the rail, according to an example embodiment. The rail 300 shown in FIG. 3 is an example of a Picatinny rail (also known as MIL-STD-1913 rail) having a plurality of slots 301, a topmost surface 302 including angled edge portions 304, and an under surface 303 extending along opposing sides of the rail 300. In the illustrated embodiment, under surface 303 is angled with respect to the upper portion of topmost surface 302 and with respect to the angled edge portions 304 of topmost surface 302. The topmost surface 302, in this case, is discontinuously formed and interspersed by the slots 301 such that the topmost surface 302 includes a plurality of coplanar surfaces. As shown in FIG. 4 and discussed in further detail below, the mount 100 mounts to the rail 300 by way of a clamping mechanism that minimally contacts the topmost surface 302 and under surface 303 of the rail 300. In other variations mount 100 may be configured to mount to any other suitable firearm rail, such as for example a NATO rail.

Figure 5:
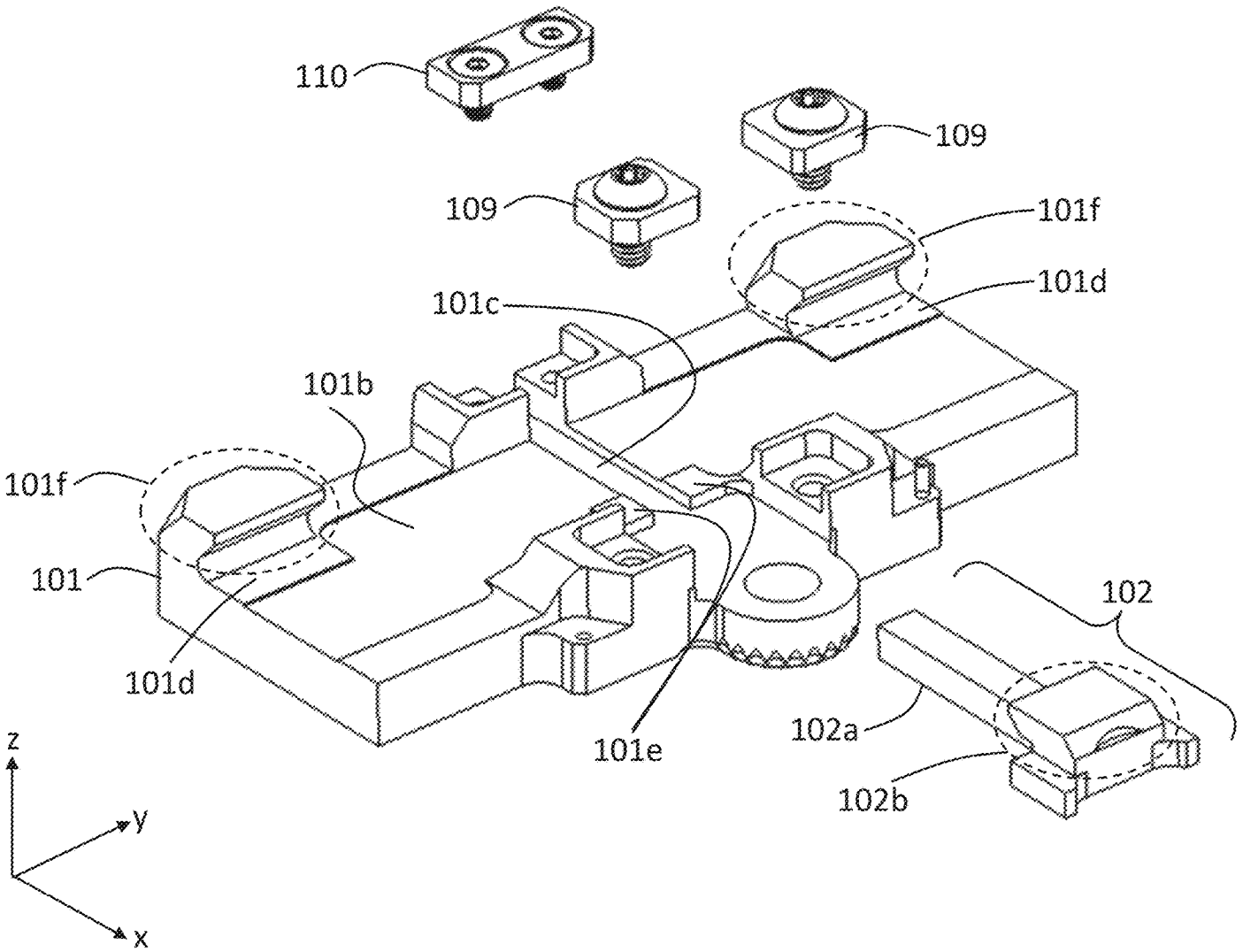
FIG. 5 shows a partial, exploded view of the mount detailing the frame and the clamp, according to an example embodiment.

FIG. 5 shows a partial, exploded view of the mount detailing its frame and clamp, according to an example embodiment. The frame 101 has a length along a first direction y, a width along a second direction x, and a height along a third direction z. A channel 101*c* is formed in a bottom surface 101*b* of the frame and extends along the second direction x. Raised pads 101*d*, which are elevated along the third direction z with respect to the bottom surface 101*b*, are formed in opposite end portions A and C (see also FIG. 2) of the frame 101 along the first direction y. In particular, the raised pads 101*d* are disposed closer to a first edge of the frame 101 extending along the first direction y than to an opposing, second edge of the frame 101. A raised pad 101*e*, which is also elevated along the third direction z with respect to the bottom surface 101*b*, is formed in an intermediate portion B and disposed closer to the opposing, second edge of the frame 101. The raised pad 101*e* may be disposed on opposing sides of the channel 101*c*.

The frame 101 also includes hook-shaped members 101*f* formed in opposite end portions A and C (see also FIG. 2) of the frame 101 along the first direction y. In particular, the hook-shaped members 101*f* are disposed closer to the first edge of the frame 101 extending along the first direction y than to the opposing, second edge of the frame 101. More about the function and configuration of the raised pads 101*d* and 101*e* and hook-shaped members 101*f* is discussed later on below.

The clamp 102 includes a guide portion 102*a* that is configured to be slidable in the channel 101*c* of the frame 101 and a hook-shaped member 102*b* disposed closer to the second edge of the frame 101 than to the first edge of the frame 101. Motion of the clamp 102 along the third direction z is constrained with respect to the frame 101 by guide brackets 109, which are secured to the frame 101 by bracket screws 111. While the clamp 102 is slidable in the channel 101*c* along the second direction, its range of motion may be limited by the endplate bracket 110, which is also secured to the frame 101 by bracket screws 111. For example, the endplate bracket 110 may include an endplate that prevents the clamp guide 102*a* from sliding and extending beyond the first edge of the frame 101. The clamp return spring 112 may be disposed between the endplate and an end of the clamp guide 102*a* to provide a return spring force that pushes the clamp 102*a* towards the second edge of the frame 101. More about the function and configuration of the hook-shaped member 102*b* and clamp return spring 112 is discussed later on below.

Figure 6:
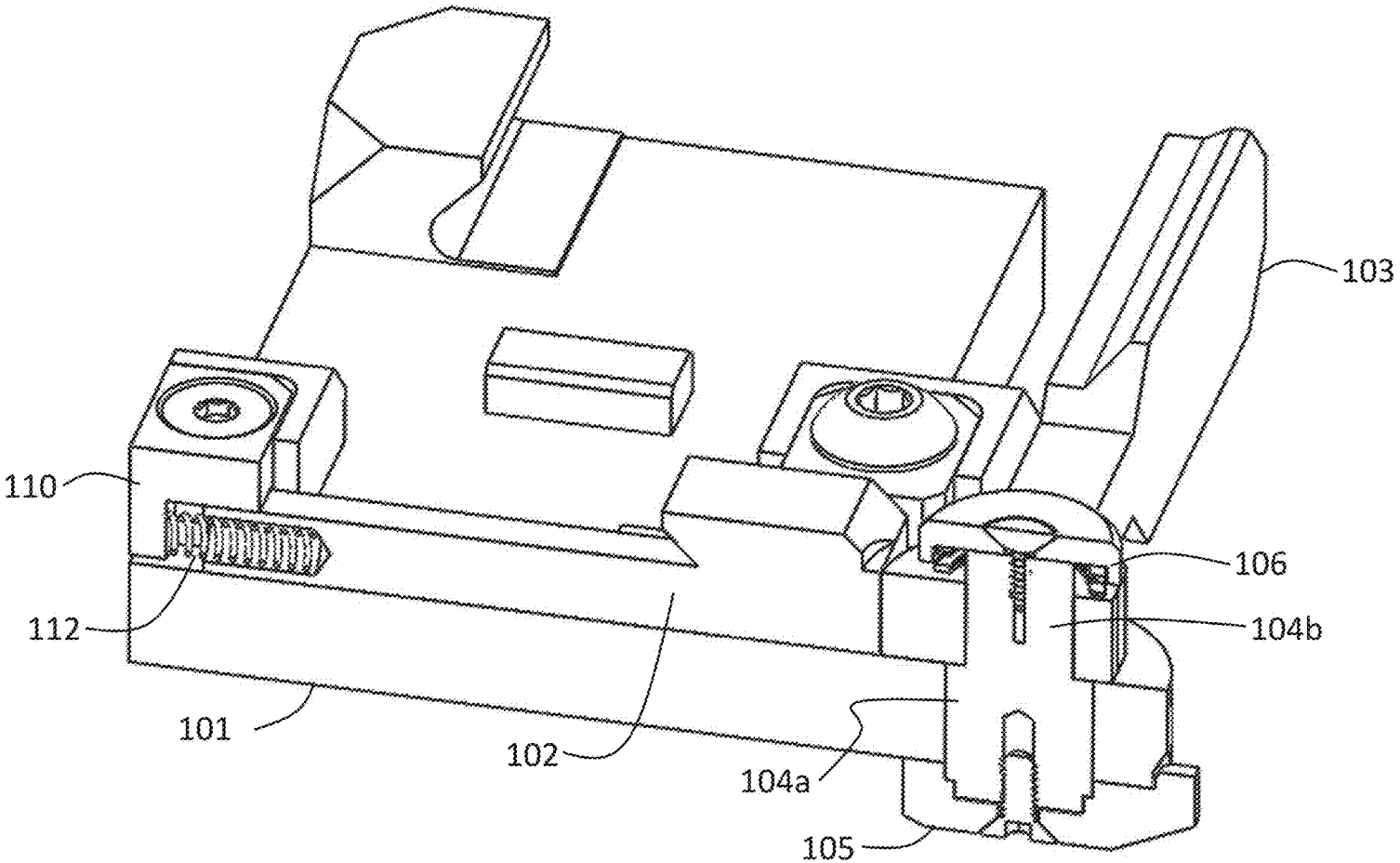
FIG. 6 shows a cross-sectional view of the mount when assembled, according to an example embodiment.

FIG. 6 shows a cross-sectional view of the mount when assembled, according to an example embodiment. In its assembled state, the clamp 102 acts as a cam follower to the lever cam 103. That is, when the lever cam 103 is rotated in one direction, it pushes the clamp 102 towards the first edge of the frame 101 along which the endplate bracket 110 is disposed. Thus, the lever cam 103 is configured to translate a rotary force applied thereto into a linear force applied to the clamp 102 along the second direction x. When the lever cam 103 is rotated in the other direction, it allows the clamp 102 to retract towards the second edge of the frame 101 via a spring force provided by the return spring 112.

As discussed earlier, a drawback of existing mounts is that, when mounting a sight, they may not always return the sight to zero due to their over constraining clamping mechanism. Existing mounts are generally designed to clamp against the surfaces of the rail using long, thin surfaces. However, due to inherent manufacturing tolerances, these long, thin surfaces of the mount, as well as the surfaces of the rail, are often not exactly flat, parallel, or angled to specification. These imperfections prevent the parts from fitting together exactly and may cause damage to the rail resulting in burrs and dings. For example, when these imperfect long, thin surfaces of the mount are clamped against the surfaces of the rail, an excessive number of contact points may be generated, resulting in an over constrained system. This means that the resting position between the mount and clamped rail becomes non-deterministic and elastically averaged. Thus, each time the mount is un-mounted and re-mounted, the resting position of the mount may slightly differ.

Figure 8:
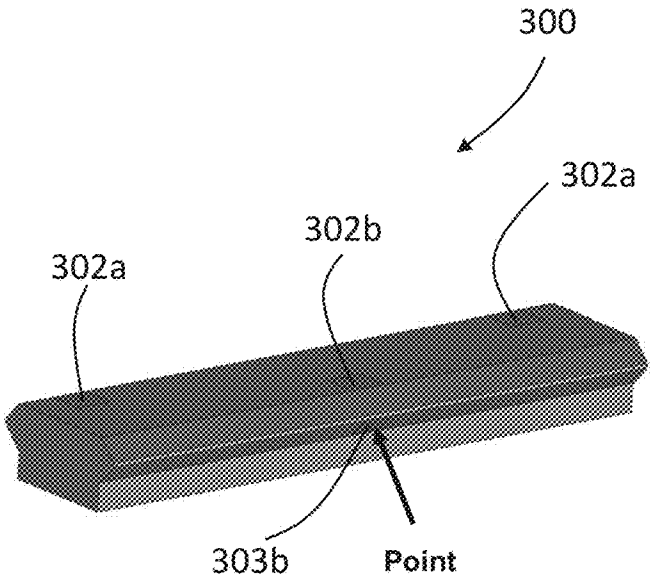
FIGS. 7 and 8 show example contact points on the rail at which the mount makes contact, according to an embodiment.
Figure 7:
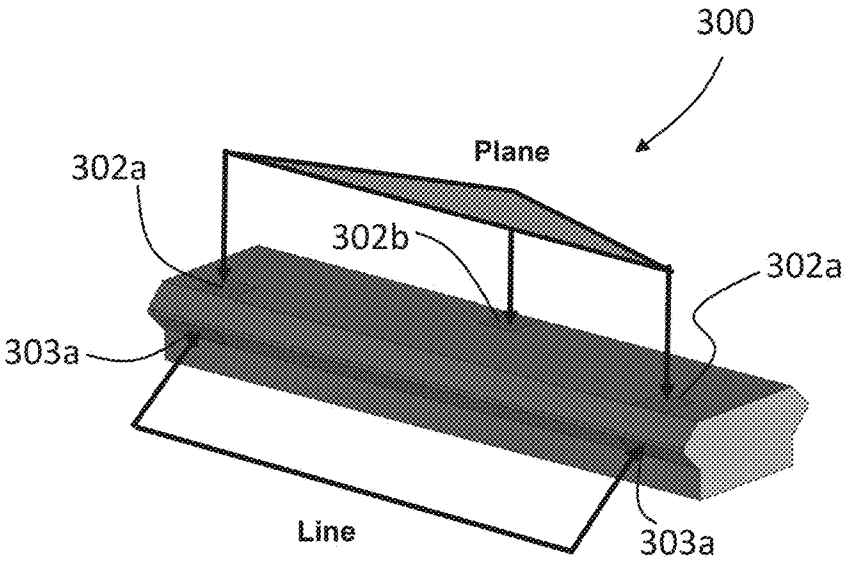
Figure 9:
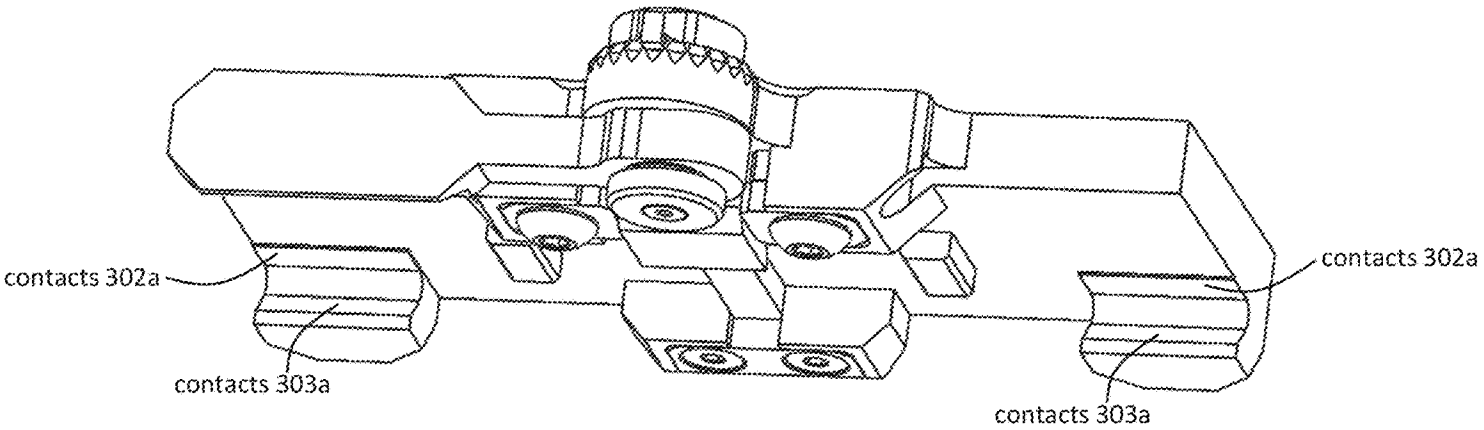
FIGS. 9 and 10 show example contact points on the mount that correspond to the contact points on the rail shown in FIGS. 7 and 8, according to an example embodiment.
Figure 10:
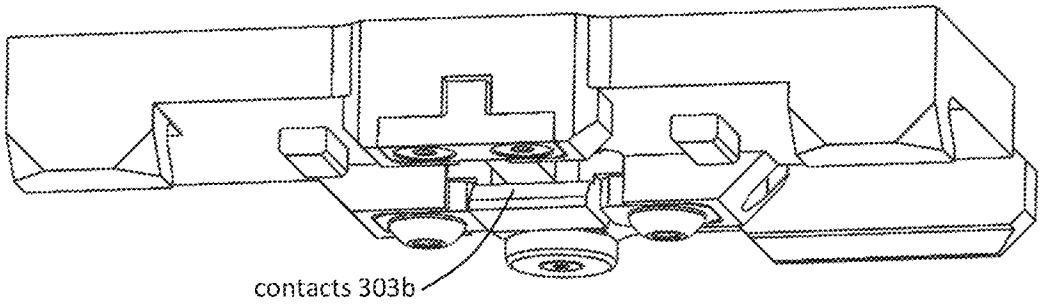

In contrast, the mount according to embodiments of the present disclosure provides a deterministic, or significantly more deterministic, resting position between the mount and rail by minimizing the number of intentional and unintentional contact points between the mount and the rail, thereby approaching that of a true kinematic rail mounting system. FIGS. 7 and 8 show example contact points on the rail at which the mount makes contact, according to an embodiment. FIGS. 9 and 10 show example contact points on the mount that correspond to the contact points on the rail, according to an example embodiment. The first set of contact areas 302*a* and 302*b* on the upper portion of topmost surface 302 of the rail 300 forms a stable triangle platform (i.e., determines a primary plane) at the furthest extents of the mount, thereby restraining the system (e.g., mount+rail) in 3 degrees of freedom (DOF). According to this embodiment, the frame 101 only contacts the topmost surface of the rail 300 by only the raised pads 101*d* and 101*e* (refer back to FIG. 5). In particular, the contact areas 302*a* are contacted by the raised pads 101*d* of the frame 101, and the contact area 302*b* is contacted by the raised pad 101*e* of the frame 101. Surfaces of the raised pads 101*d* and 101*e* contacting the topmost surface 302 of the rail 300 are formed to be discontinuous with each other to minimize the size of the contact areas with the rail. These small contact areas provide a more deterministic restraining solution approaching that of a perfectly constrained system.

A second set of contact areas 303*a* on the under surface 302 along one side of the rail 300 constrains the system in two more DOF (i.e., determines a line). The contact areas 303*a* are disposed adjacent to the contact areas 302*a* to face each other so as to reduce the degree of freedom in the system. According to this embodiment, the frame 101 contacts the under surface along the one side of the rail 300 by only the hook-shaped members 101*f* (refer back to FIG. 5). Surfaces of the hooked-shaped members 101*f* contacting the under surface of the rail are formed to be discontinuous with each other, rather than forming one long continuous surface, to minimize the size of the contact areas with the rail. Again, these small contact areas provide a more deterministic restraining solution approaching that of a perfectly constrained system.

A last contact area 303*b* on the under surface 302 along an opposing side of the rail 300 constrains the system in another DOF (i.e., determines a point). The contact area 303*b* is disposed adjacent to the contact area 302*b* to face each other so as to reduce the amount of flex in the system, that is, to increase the stiffness of the system. According to this embodiment, the mount contacts the under surface along the opposing side of the rail 300 by only the hook-shaped member 102*b* (refer back to FIG. 5) of the clamp 102. When actuated by the lever cam 103, the clamp 102 forces the rail 300 up against the other 5 contact areas and by friction, constrains the mount to the rail 300, thereby removing the last DOF.

Referring again to FIG. 5, according to another embodiment raised pads 101*d* and 101*e*, hook shaped members 101*f*, and/or hooked shaped member 102*b* of clamp 102 comprise curved (e.g., large radius spherical) surfaces where they make contact with the rail. Some, all, or any combination of these features may comprise such curved surfaces. This way, the curved (e.g., spherical) contact area (or patch) between the flat surface (rail) and the curved surface (mount) becomes smaller. As the contact patch becomes smaller, the system approaches that of a true kinematic mounting system (e.g., point contact on a flat surface). Also, the contact patch (spherical surface) may be sized (radius) to limit the Hertzian stresses in the material.

Figure 11:
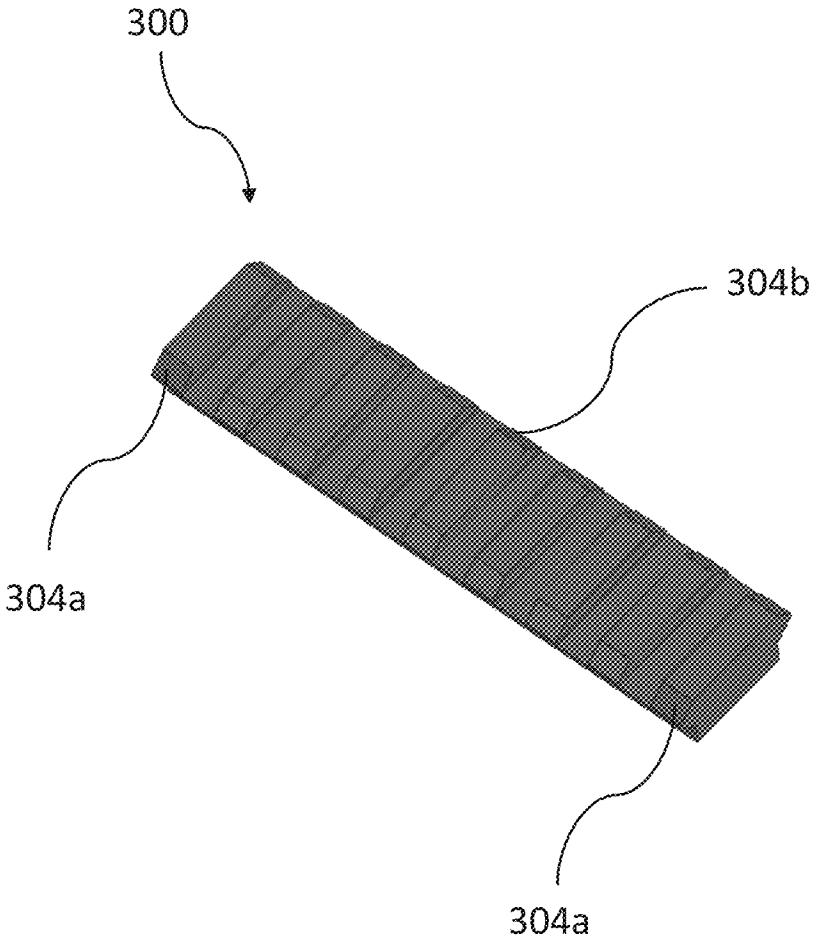
FIG. 11 shows an alternative set of contact points on the rail at which the mount may make contact, according to another embodiment.

Referring now to FIG. 11, in another embodiment the mount may be configured to make contact with the topmost surface of the rail at three points 304*a* and 304*b* located on angled edge portions 304 of topmost surface 302. The set of contact areas 304*a* and 304*b* forms a stable triangle platform (i.e., determines a primary plane) at the furthest extents of the mount, thereby restraining the system (e.g., mount+rail) in 3 degrees of freedom (DOF) similarly to the set of contact areas 303*a* and 303*b* shown in FIGS. 7 and 8.

In summary, the mount according to example embodiments disclosed herein provides an advantage over existing mounts. The presently disclosed mount provides a deterministic, or significantly more deterministic, resting position between the mount and rail by minimizing the number of intentional and unintentional contact points between the mount and the rail, thereby approaching that of a true kinematic mounting system that is significantly better suited for mounting a sight on a firearm.

The various features of the representative examples and the dependent claims may be combined in ways that are not specifically and explicitly enumerated in order to provide additional embodiments of the present teachings. The dimensions and the shapes of the components shown in the figures are designed to help understand how the present teachings are practiced and do not limit the dimensions and the shapes shown in the examples.

What is claimed is:

1. A kinematic rail mount for mounting a device on a rail, the rail including a topmost surface and an under surface along opposing sides of the rail, the mount comprising:

a frame having a length along a first direction, a width along a second direction, and a height along a third direction; and a clamp operatively connected to the frame to be slidable along the second direction, wherein:

the frame has a first end portion and a second end portion arranged along the first direction and an intermediate portion disposed between the first and second end portions, the clamp includes a guide disposed in a channel formed in the intermediate portion of the frame, the first end portion and second end portion include, respectively, a first raised pad and a second raised pad, each raised pad disposed closer to a first edge of the frame than to a second edge of the frame, the first and second edges being opposing edges extending along the first direction, and the intermediate portion includes a third raised pad disposed closer to the second edge of the frame than to the first edge of the frame, wherein the frame is configured to contact the topmost surface of the rail by only the first, second and third raised pads of the frame.

2. The kinematic rail mount of claim 1, wherein a surface of the first raised pad contacting the topmost surface of the rail, a surface of the second raised pad contacting the topmost surface of the rail, and a surface of the third raised pad contacting the topmost surface of the rail are discontinuous with each other.

3. The kinematic rail mount of claim 1, wherein:

the first end portion and second end portion include, respectively, a first hook-shaped member and a second hook-shaped member, each hook-shaped member disposed closer to the first edge of the frame than to the second edge of the frame, and the clamp includes a third hook-shaped member disposed closer to the second edge of the frame than to the first edge of the frame.

4. The kinematic rail mount of claim 3, wherein:

the frame is configured to contact the under surface along one side of the rail by only the first and second hook-shaped members, and the clamp is configured to contact the under surface along an opposing side of the rail by the third hook-shaped member.

5. The kinematic rail mount of claim 4, wherein a surface of the first hook-shaped member contacting the under surface of the rail along the one side is discontinuous with a surface of the second hook-shaped member contacting the under surface of the rail along the one side.

6. The kinematic rail mount of claim 1, wherein the third raised pad is disposed on opposing sides of the channel.

7. The kinematic rail mount of claim 4, wherein at least one of the first raised pad, the second raised pad, the third raised pad, the first hooked-shaped member, the second-hooked shaped member, and the third hook-shaped member comprises a curved surface where it contacts the rail.

8. The kinematic rail mount of claim 7, wherein the curved surface has a spherical shape.

9. The kinematic rail mount of claim 4, wherein each of the first raised pad, the second raised pad, the third raised pad, the first hooked-shaped member, the second-hooked shaped member, and the third hook-shaped member comprises a curved surface where it contacts the rail.

10. The kinematic rail mount of claim 9, wherein the curved surfaces have spherical shapes.

11. The kinematic rail mount of claim 4, wherein each of the first raised pad, the second raised pad, and the third raised pad comprise a curved surface where it contacts the rail.

12. The kinematic rail mount of claim 10, wherein the curved surfaces have spherical shapes.

13. The kinematic rail mount of claim 1, wherein the topmost surface of the rail comprises angled edge portions.

14. The kinematic rail mount of claim 13, wherein the frame is configured to contact the topmost surface of the rail by only the first, second and third raised pads of the frame and only on the angled edge portions of the topmost surface.

* * * * *